United States Patent [19]

Hazenbosch et al.

[11] 4,059,446

[45] Nov. 22, 1977

[54] PROCESSING OF PHOTOGRAPHIC SILVER HALIDE MATERIAL

[75] Inventors: Edwin Hendrik Hazenbosch, Mechelen; Antoine Roberta Van Rossen, Brustem; Roland François Beels, Linkebeek; Marcel Frans Aelterman, Mortsel, all of Belgium

[73] Assignee: AGFA-GEVAERT N.V., Mortsel, Belgium

[21] Appl. No.: 676,006

[22] Filed: Apr. 12, 1976

[30] Foreign Application Priority Data

Apr. 30, 1975 United Kingdom ..... 18067/75

[51] Int. Cl.[2] ..... G03C 5/26; G03C 5/38

[52] U.S. Cl. ..... 96/50 R; 96/61 R

[58] Field of Search ..... 96/50 R, 61 R, 66

[56] References Cited

U.S. PATENT DOCUMENTS

| | | | |
|---|---|---|---|
| 2,556,540 | 6/1951 | Henn et al. | 96/50 R |
| 3,558,313 | 1/1971 | Tsuchida et al. | 96/61 R |
| 3,653,904 | 4/1972 | Friedel | 96/61 R |
| 3,667,951 | 6/1972 | Fassbender et al. | 96/50 |
| 3,684,512 | 8/1972 | Cain | 96/61 R |
| 3,705,800 | 12/1972 | Lane | 96/60 R |
| 3,746,543 | 7/1973 | Iwano | 96/61 R |
| T879,007 | 10/1970 | Wilson | 96/61 R |
| T887,022 | 6/1971 | Kalenda | 96/61 R |

FOREIGN PATENT DOCUMENTS

| | | | |
|---|---|---|---|
| 1,187,170 | 9/1959 | France | 96/61 R |
| 2,126,416 | 12/1971 | Germany | 96/61 R |

*Primary Examiner*—Mary F. Kelley
*Attorney, Agent, or Firm*—A. W. Breiner

[57] ABSTRACT

Sludge formation is reduced in the fixing and washing station of an automatic processing apparatus for rapid processing exposed photographic elements, by addition to the fixing and/or washing medium of a compound of the formula:

$$R(OCH_2CH_2)_nOH$$

wherein $n$ is at least 12 and R is an aliphatic group of 6 to 24 carbon atoms or an alkylaryl group.

10 Claims, No Drawings

PROCESSING OF PHOTOGRAPHIC SILVER HALIDE MATERIAL

The present invention relates to processing of radiation-sensitive photographic silver halide materials.

In the formation of a stable visible image, a silver halide emulsion layer containing a latent image by image-wise exposure to radiation is developed, fixed, washed and dried.

In order to reduce processing time and to permit handling of large amounts of exposed photographic materials, automatic processing machines are used to develop, fix, wash and dry exposed photographic materials. In these automatic processing machines the material is guided from one processing station to another and loss of activity of the processing solution as well as contamination by ingredients diffusing out of the photographic material is counteracted by continual replenishment and by introducing fresh processing solutions periodically.

Upon repeated use of the processing solutions, various types of deposits often build up in these solutions which not only become attached to the materials being processed, but also to parts of the processing machine e.g.transport rollers and other guiding means.

Deposits may be formed not only in the developing station but also in the fixing station and the washing station in the form of a sludge. This sludge is often due to ingredients present in the photographic material which are leached out by the developer solution and although they dissolve therein they are transferred to the fixing station and the washing station where they precipitate.

The problem of sludge formation is particularly great when rapid processing exposed radiographic silver halide emulsions at temperatures above 25° C, especially above 30° C, in automatic processing machines operating with restricted amounts of wash-water.

For the rapid processing at elevated temperature the emulsions usually have a low ratio of binder to silver halide, more particularly gelatin to silver halide, e.g. comprised between about 3:10 and about 7:10 and the development occurs by means of a hardening developer e.g. containing an aldehyde hardener in order to avoid excessive softening and swelling of the emulsions.

It has now been found that sludge formation in the fixing station and more particularly in the washing station of automatic processing machines used for rapid processing silver halide elements, especially radiographic silver halide elements, can be reduced or eliminated by addition to the fixing solution and/or washing medium of a polyoxyethylene compound of the formula :

$$R—(OCH_2CH_2)_nOH$$

wherein:

*n* is an integer of at least 12 and preferably at most 40,

*R* is a saturated or unsaturated aliphatic straight-chain or branched-chain group e.g. alkyl or alkenyl with 6 to 24, preferably 8 to 18 carbon atoms, or an alkylaryl group in which the aryl group may be mononuclear or multinuclear e.g. alkylated phenyl or naphthyl, the alkyl group(s) being straight-chain or branched-chain alkyl and containing preferably 4 to 10 carbon atoms when the aryl is naphthyl and 6 to 14 carbon atoms when the aryl is phenyl.

Preferred compounds are the ethoxylated straight-chain or branched-chain alcohols containing 8 to 18 carbon atoms e.g. lauryl, myristyl, isohexadecyl, and isooctadecyl alcohol, ethoxylated unsaturated alcohols e.g. oleylalcohol and ethoxylated alkylphenols e.g. isooctylphenol, nonylphenol, isononylphenyl and dodecylphenol. The ethoxylated alkylphenols are the most preferred antisludgants for use in the fixing and/or washing solutions according to the present invention.

The present invention thus provides a method of rapid processing photographic silver halide material in a processing machine of the automatic type wherein the exposed photographic material is sequentially developed in a hardening developer, fixed in a thiosulphate or thiocyanate fixing solution, washed and dried characterised in that the fixing and/or washing solution comprises a polyoxyethylene compound of the above formula in an amount to effectively reduce sludge-formation.

The polyoxyethylene compounds of the above formula are preferably used in the fixing solution. They reduce the tendency for sludge formation both in the fixing solution and the washing solution without impairing uniform fixation of the photographic material. The number of ethylene oxide units in the polyoxyethylene compound used in accordance with the present invention is at least 12 and preferably at most 40. With a lower number of ethylene oxide units sludge formation is not sufficiently reduced whereas with a higher number of ethylene oxide units there is a foaming problem which, however, could be eliminated by supplemental addition to the fixing solution of a defoaming agent.

In the method of the present invention, the polyoxyethylene compounds may be added to the fixing solution and/or washing solution in widely varying amounts. They are preferably employed in amounts between about 0.05 g and about 5 g, most preferably between 0.5 and 5 g, per liter.

In the method of the present invention the exposed photographic elements are developed in a hardening developer.

Hardening developers usually comprise an aldehyde hardening agent, more particularly a dialdehyde hardening agent or bisulphite addition compounds thereof. Examples of suitable aldehyde hardeners are formaldehyde, glutaraldehyde, α-methylglutaraldehyde, β-methylglutaraldehyde, α-butoxyglutaraldehyde, α-methyl-β-ethoxyglutaraldehyde, α,α-dimethylglutaraldehyde, α,β-dimethylglutaraldehyde, maleindialdehyde, butylamleindialdehyde, succindialdehyde, methylsuccindialdehyde, methoxysuccindialdehyde, β-isopropoxysuccindialdehyde, cyclopentandicarboxaldehyde, etc. The developer may comprise any of the conventional silver halide developing agents which include dihydroxybenzene compounds e.g. hydroquinone, chlorohydroquinone, bromohydroquinone, isopropylhydroquinone, toluhydroquinone, methylhydroquinone, 2,3-dichlorohydroquinone, 2,5-dimethylhydroquinone and the like, 3-pyrazolidinones e.g. 1-phenyl-3-pyrazolidinone, 1-phenyl-4-phenyl-3-pyrazolidinone, 1-phenyl-4,4-dimethyl-3-pyrazolidinone, 1-phenyl-4-ethyl-3-pyrazolidinone, 1-phenyl-5-methyl-3-pyrazolidinone and the like, aminophenols e.g. o-aminophenol, p-aminophenol, N-methyl-o-aminophenol, N-methyl-p-aminophenol, 2,4-diaminophenol and the like, pyrogallol, ascorbic acid, etc. Usually the developer comprises a superadditive combination of developing agents e.g. hydroquinone and N-methyl-p-aminophenol and hydroquinone and 1-phenyl-3-pyrazolidinone.

The developer may further comprise the usual ingredients : alkali e.g. sodium or potassium hydroxide or carbonate, buffers e.g. boric acid and borates, development restrainers e.g. potassium bromide, developer preservatives e.g. sodium sulphite, bisulphites, e.g. potassium metabisulphite, antifoggants e.g. mercapto compounds, silver halide solvents, development accelerating onium compounds e.g. of the type described in U.S. Pat. Nos. 3,682,634 and 3,713,827 e.g. 1,1'-tetramethylene-bis(pyridinium chloride) and 1,1'-ethylene-2,2'-dipyridiniumdibromide, polyoxyalkylene compounds e.g. polyethylene glycols and esters thereof, Ca-sequestering agents e.g. soidum hexametaphosphate, ethylene diamine tetraacetic acid, nitrilotriacetic acid, wetting agents, etc.

The fixing solutions used in the method of the present invention can comprise any of the conventional alkali metal or ammonium thiosulphate or thiocyanate fixing agents e.g. sodium thiosulphate, potassium thiosulphate, lithium thiosulphate, ammonium thiosulphate, sodium thiocyanate, potassium thiocyanate, and ammonium thiocyanate. The fixing agents are used in conventional amounts e.g. between about 0.1 and about 5 moles per liter.

The fixing solution further comprises the usual ingredients which include acids to obtain the required acidity, which is generally between about pH 3.5 and pH 5.5, e.g. sulphuric acid, boric acid, acetic acid, citric acid, buffers e.g. sodium acetate, sodium citrate, borates, hardeners e.g. chrome alum and potassium alum or other aluminium hardeners e.g. aluminium chloride and aluminium sulphate, sulphites and bisulphites, water-softening agents, e.g. ethylene diamine tetraacetic acid salts and polyphosphates e.g. sodium hexametaphosphate, defoaming agents e.g. 2-octanol, sulphonated ores, sulphonated silicones, etc.

The photographic elements for being processed according to the method of the present invention comprise a support with at one or both sides thereof at least one silver halide emulsion layer. The emulsion may comprise as light-sensitive silver halide : silver bromide, silver chloride, or mixed silver halides e.g. silver chlorobromide, silver chlorobromoiodide, silver bromoiodide, and silver chloroiodide. The invention is particularly concerned with rapid processing of radiographic silver halide elements comprising as light-sensitive silver halide silver bromide or silver bromoiodide the iodide content being generally at most 5 mole %.

The emulsions can be chemically sensitized by any of the accepted procedures. The emulsions can be digested with naturally active gelatin or with sulphur containing compounds such as allyl isothiocyanate, allyl thiourea or sodium thiosulphate. The emulsions can also be digested in the presence of reducing agents e.g. the tin compounds described in Belgian Pat. Nos. 493,464 and 568,687, the iminoamino methane sulphinic acid compounds described in United Kingdom patent specification No. 789,823, polyamines e.g. diethylene triamine, spermine and bis($\beta$-aminoethyl)sulphide. They can further be digested in the presence of noble metal compounds such as ruthenium, rhodium, palladium, iridium, platinum and gold compounds as described by R. Koslowsky, Z. Wiss. Phot. 46, 65–72 (1951). Representative compounds are ammonium chloropalladate, potassium chloroplatinate, sodium chloropalladite, potassium chloroaurite, potassium aurithiocyante, potassium chloroaurate, gold(III)chloride, gold(I)sulphide, etc.

The emulsions can comprise emulsion-stabilizers and fog-inhibiting compounds e.g. the mercury compounds such as those described in Belgian Patent Specification Nos. 524,121 and 677,337 and in published Dutch Patent Application No. 67/15932, organic sulphur-containing compounds that form insoluble silver salts with silver ions, heterocyclic nitrogen-containing thioxo compounds or derivatives thereof, e.g. benzothiazoline-2-thione, 1-phenyl-2-tetrazoline-5-thione and 2-ethoxycarbonylthio-5-amino-thiadiazole, the compounds described in Belgian Patent Specification Nos. 571,916 and 571,917, thiazolinium compounds of the type described in Product Licensing Index, December 1971 issue, p. 90–91, benzothiazolium compounds e.g. 2,3-dimethyl-5-methoxycarbonyl benzthiazolium p-toluene sulphonate and tetra- or pentaazaindenes especially those substituted by hydroxyl or amino groups e.g. those described by Birr, Z. Wiss. Phot. 47, 2–58 (1952). A very effective azaindene emulsion stabilizer is 5-methyl-7-hydroxy-s-triazolo[1,5-a]pyrimidine which can be used together with other emulsion stabilizers e..g. those of the type described above.

The emulsions may be spectrally sensitized by means of neutrocyanines, carboxycyanines, rhodacyanines, hemicyanines, merocyanines, oxonol dyes, styryl dyes and the like as described by F. M. Hamer in "The cyanine dyes and related compounds" (1954).

The emulsions may further comprise other compounds that sensitize the emulsion by development acceleration e.g. alkylene oxide polymers. These alkylene oxide polymers may be of various type e.g. polyethylene glycol having a molecular weight of 1500 or more, alkylene oxide condensation products or polymers as described in U.S. Pat. Nos. 1,970,578 — 2,240,472 — 2,423,549 — 2,441,389 — 2,531,832 and 2,533,990 and in United Kingdom patent specification Nos. 920,637 — 940,051 — 945,340 — 991,608 and 1,015,023. These development accelerating compounds may also be present in the silver halide developing solution. Other development accelerating compounds are onium and polyonium compounds preferably of the ammonium, phosphonium and sulphonium type.

Other addenda e.g. hardening agents such as formaldehyde, mucochloric and mucobromic acid, dialdehydes etc., wetting agents, plasticizers, matting agents, e.g. polymethylmethacrylate and silicon particles, light-screening dyes, etc. may be present in the silver halide emulsion or another layer of the light-sensitive silver halide materials which are to be processed according to the method of the present invention.

The following example illustrated the present invention.

EXAMPLE

Samples of a commercial medical X-ray film material were processed in an automatic processing machine wherein the overall processing time is 120 sec and comprises developing (30 sec at 34° C), fixing (30 sec at 32° C), washing (30 sec at room temperature) and drying (30 sec). The amount of wash water is limited to 1 liter per sq.m of film processed.

The developing solution had the following composition:

hydroquinone: 30 g
1-phenyl-3-pyrazolidone: 2 g sodium sulphite: 20 g
potassium metabisulphite: 40 g
ethylene diamine tetraacetic acid tetrasodium salt: 2 g
potassium bromide: 3 g
25% glutaraldehyde solution: 20 ml
6-nitrobenzimidazole: 0.20 g
acetic acid: 10 g
potassium hydroxide and water to obtain 1 liter of pH 10.30

The fixing solution had the following composition:

ammonium thiosulphate: 200 g
sodium sulphite: 10 g
boric acid: 5 g
sodium acetate-3-water: 20 g
glacial acetic acid: 10 ml
aluminium chloride-6-water: 10 g
water to make 1 liter.

After the machine had been processing X-ray films for about 1 hour a sludge was seen in the fixing solution and especially in the washing solution.

When repeating the experiment employing a same fixing solution but to which 2 g of ethoxylated nonylphenol comprising 30 ethyleneoxide units were added per liter no sludge formation was observed, even after several weeks of processing.

The same favourable effect was obtained when adding to the fixing solution 2 g of ethoxylated nonylphenol comprising 15 ethyleneoxide units. However, when the number of ethylene oxide units was 10 or less, the ethoxylated nonylphenol was not effective to reduce sludge formation sufficiently.

We claim:

1. A method of rapid processing of black and white photographic silver halide material in a processing machine of the automatic type wherein the imagewise exposed photographic material is sequentially developed in a hardening developer, fixed in a thiosulphate or thiocyanate fixing solution, washed and dried, characterized in that the fixing medium and/or washing medium contains a polyoxyethylene compound of the formula:

$$R—(OCH_2CH_2)_nOH$$

wherein:

$n$ is an integer of at least 12, and

R is an aliphatic group containing from 6 to 24 carbon atoms or an alkyl phenyl group comprising $C_6$–$C_{24}$ carbon atoms in the alkyl chain or alkyl naphthyl comprising $C_4$–$C_{10}$ carbon atoms in the alkyl chain.

2. A method according to claim 1, wherein the polyoxyethylene compound is an ethoxylated alkylphenol.

3. A method according to claim 1, wherein the polyoxyethylene compound is used in an amount from about 0.05 g to about 5 g per liter.

4. A method according to claim 1, wherein the polyoxyethylene compound is used in the fixing medium.

5. A method according to claim 1, wherein the hardening developer comprises a dialdehyde hardener or a bisulphite addition product thereof.

6. Method according to claim 5, wherein the dialdehyde hardener is glutaraldehyde.

7. A method according to claim 1, wherein the photographic silver halide material is a radiographic silver halide material, comprising at least one silver bromide or silver bromoiodide emulsion.

8. A method according to claim 1, wherein the polyoxyethylene compound is ethoxylated nonylphenol comprising from about 15 to about 30 recurring ethylene oxide units.

9. A method according to claim 1, wherein R is a saturated alkyl group.

10. A method according to claim 1, wherein R is an unsaturated alkyl group.

* * * * *